US005913526A

United States Patent [19]

Olson et al.

[11] Patent Number: 5,913,526

[45] **Date of Patent: *Jun. 22, 1999**

[54] ADJUSTABLE FIT IN-LINE SKATE

[75] Inventors: Todd Jack Olson, Chanhassen; Thomas Lee Spaulding, St. Louis Park; Alan Eugene Doop, Delano, all of Minn.

[73] Assignee: Rollerblade, Inc., Eden Prairie, Minn.

[ * ] Notice: This patent is subject to a terminal disclaimer.

[21] Appl. No.: 08/908,863

[22] Filed: Aug. 8, 1997

Related U.S. Application Data

[63] Continuation of application No. 08/477,181, Jun. 7, 1995, Pat. No. 5,678,833.

[51] Int. Cl.[6] ..... A63C 17/00

[52] U.S. Cl. ..... 280/11.22; 280/11.26; 280/11.3; 36/97; 36/115

[58] Field of Search ..... 280/11.19, 11.22, 280/11.26, 11.27, 11.28, 11.3, 841; 36/97, 102.115

[56] References Cited

U.S. PATENT DOCUMENTS

| | | | |
|---|---|---|---|
| 2,572,050 | 10/1951 | Ornstein | 280/11.3 |
| 5,171,033 | 12/1992 | Olson et al. | 36/115 |
| 5,184,834 | 2/1993 | Yu | 280/7.13 |
| 5,357,695 | 10/1994 | Lu | 36/115 |
| 5,397,141 | 3/1995 | Hoshizaki et al. | 280/11.22 |
| 5,634,648 | 6/1997 | Tonel et al. | 280/11.2 |
| 5,645,288 | 7/1997 | Lu | 280/11.19 |
| 5,678,833 | 10/1997 | Olson et al. | 280/11.22 |

FOREIGN PATENT DOCUMENTS

| | | | |
|---|---|---|---|
| 356398 | 2/1990 | European Pat. Off. | 36/97 |
| 2672812 | 8/1992 | France | 280/11.26 |
| 94/14350 | 7/1994 | WIPO | 36/115 |

*Primary Examiner*—J J Swann
*Assistant Examiner*—David R. Dunn
*Attorney, Agent, or Firm*—Merchant, Gould, Smith, Edell, Welter & Schmidt, P.A.

[57] ABSTRACT

An adjustable fit in-line skate having a rigid frame carrying a plurality of skate wheels is provided. A boot is secured to the frame with the boot having a toe portion and a heel portion. The heel portion has a sole plate which is carried over the length of the frame. The toe portion receives the sole plate and is slidably attached to the heel portion.

21 Claims, 8 Drawing Sheets

ADJUSTABLE FIT IN-LINE SKATE

CROSS REFERENCE TO RELATED APPLICATIONS

This is a Continuation of patent application Ser. No. 08/477,181, filed Jun. 7, 1995, now U.S. Pat. No. 5,678,833, which application is incorporated herein by reference.

BACKGROUND OF THE INVENTION

1. Field of the Invention

This invention pertains to skates such as in-line skates and the like. More particularly, this invention pertains to such a skate which may accommodate a variety of shoe sizes.

2. Description of the Prior Art

In recent years, the sport of in-line skating has enjoyed a tremendous growth in popularity. In addition to being enjoyable exercise for adults, children have participated in in-line skating.

High quality in-line skates can be expensive. The expense is particularly frustrating for parents of young children. As the children grow, their foot sizes expand necessitating frequent replacement of footwear of any type including recreational footwear such as in-line skates.

In the past, in-line skate manufacturers have accommodated growth in foot size by having an oversized molded boot containing a replaceable liner. Liners of various wall thicknesses could be provided such that the liners could be replaced to accommodate different foot sizes. Alternatively, various techniques have been provided for permitting the boot of the skate to adjust to accommodate growth in foot size. However, such techniques have commonly been lacking in providing for a construction which is secure after adjustment and without impairing performance of the skate.

SUMMARY OF THE INVENTION

According to a preferred embodiment of the present invention, an adjustable fit in-line skate is provided having a rigid frame with a plurality of in-line skate wheels secured to the frame. A boot is secured to the frame with the boot having a toe portion and a heel portion. The heel portion includes a sole and the heel portion is fixed to the frame. The toe portion has a base and is fastened to the heel portion by means which releasably secure each of the base and the sole to at least a portion of the frame. The toe portion is slidable relative to the heel portion along a line of travel which is generally parallel to the longitudinal dimension of the skate. The toe portion may be fixed at any one of a plurality of fixed positions along the line of travel.

DESCRIPTION OF THE PREFERRED EMBODIMENT

Figure 2:
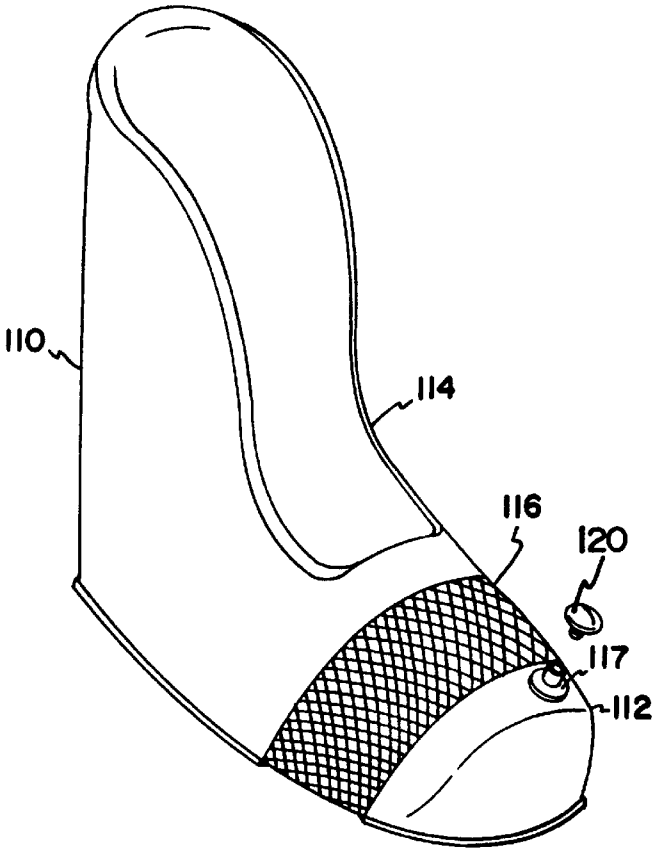
FIG. 2 is an exploded perspective view of a liner for use with the skate of FIG. 1.
Figure 1:
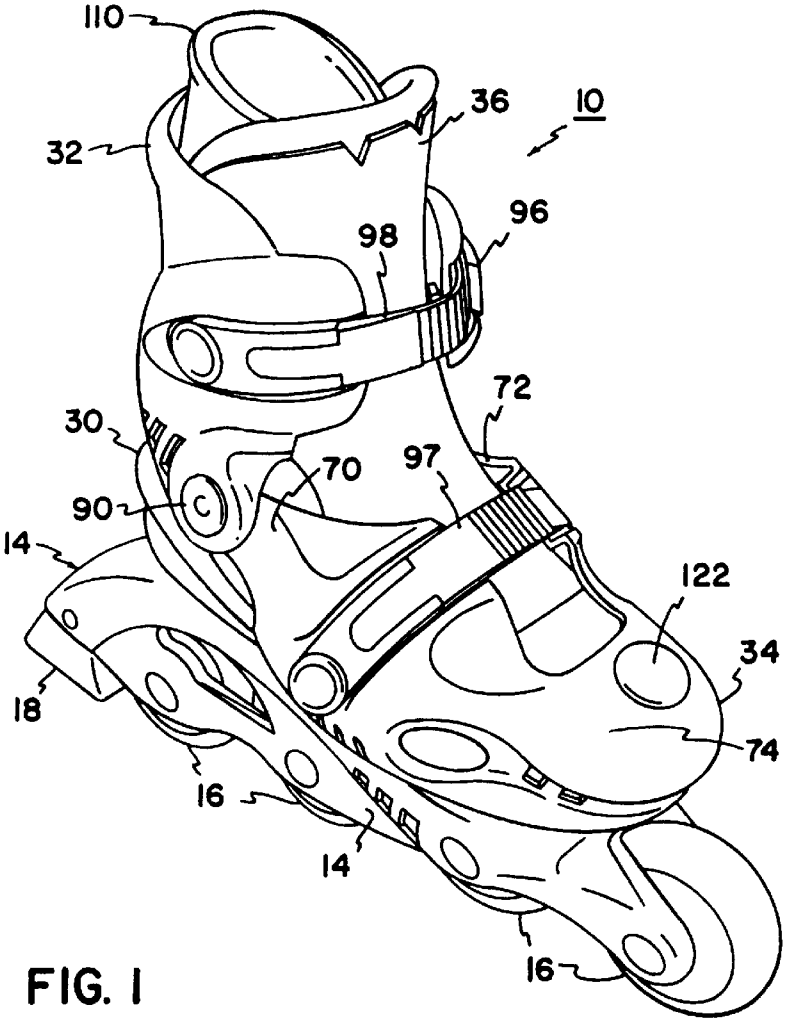
FIG. 1 is a front, right and top perspective view of the skate of the present invention.
Figure 3:
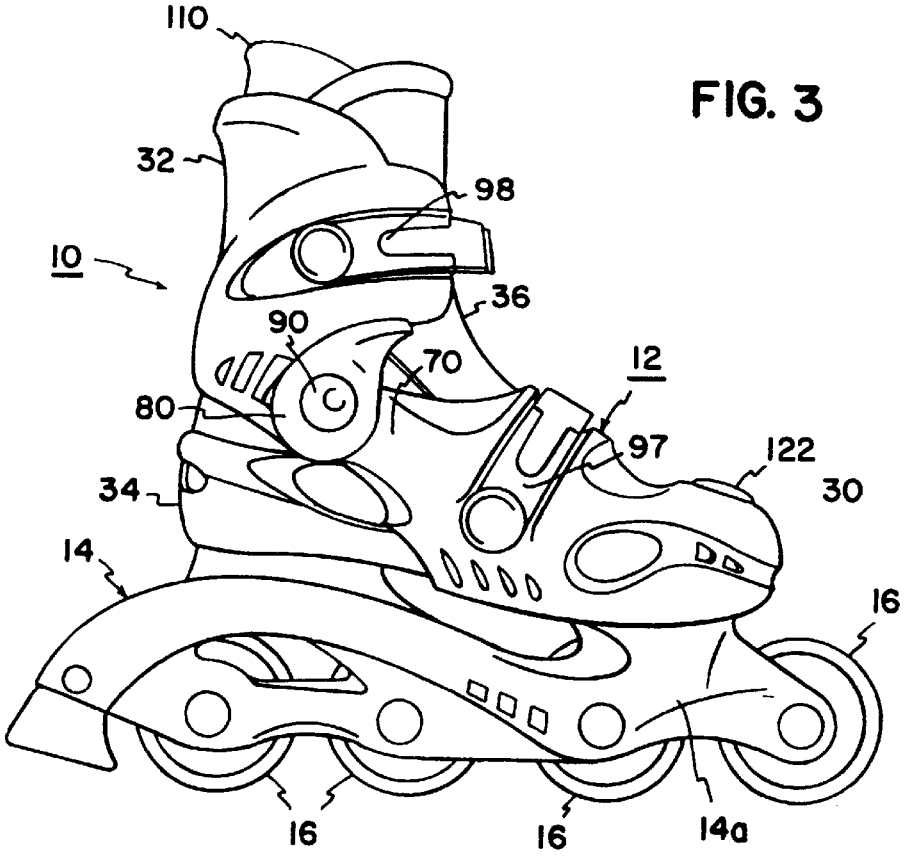
FIG. 3 is a right side elevation view of the skate of FIG. 1 shown adjusted to a minimum foot size adjustment.
Figure 4:
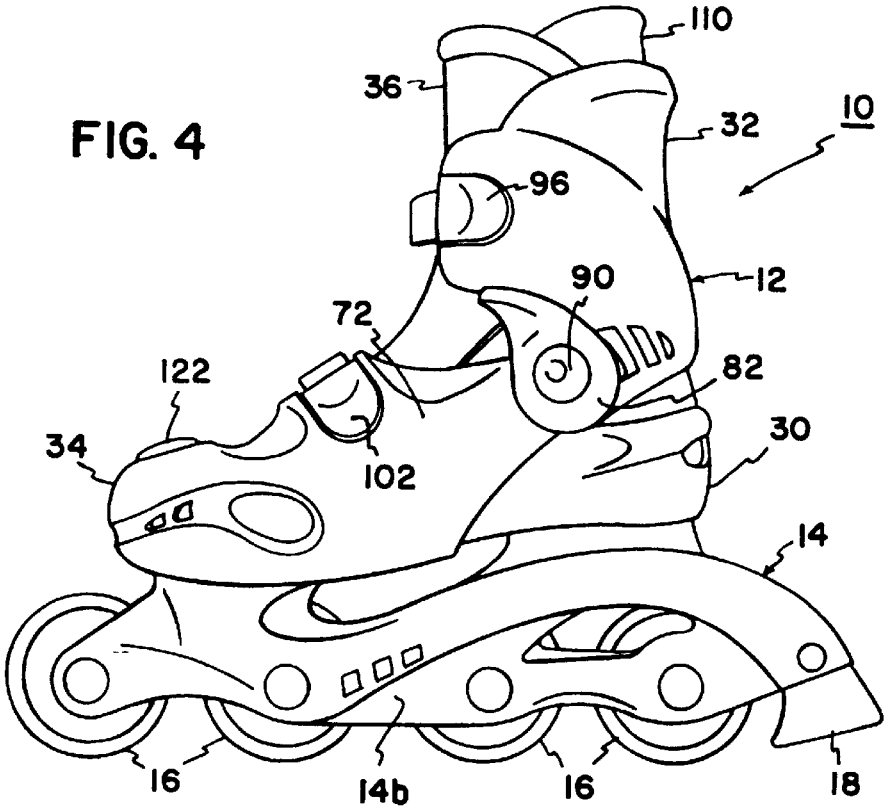
FIG. 4 is a left side elevation view of the skate of FIG. 1.
Figure 5:
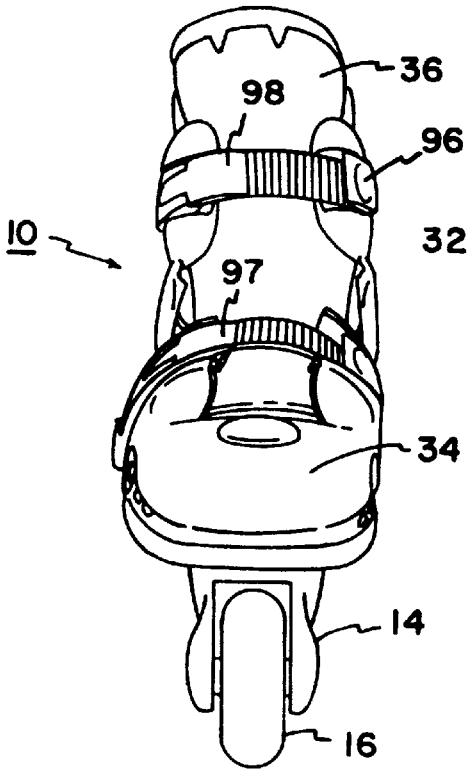
FIG. 5 is a front elevation view of the skate of FIG. 1.
Figure 6:
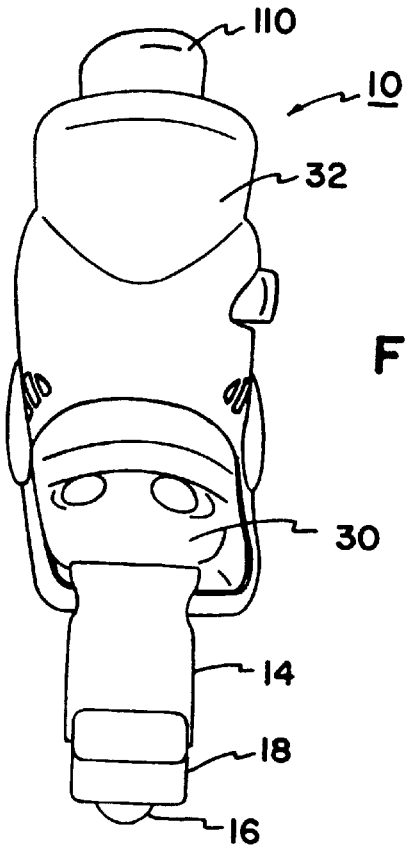
FIG. 6 is a rear elevation view of the skate of FIG. 1.
Figure 7:
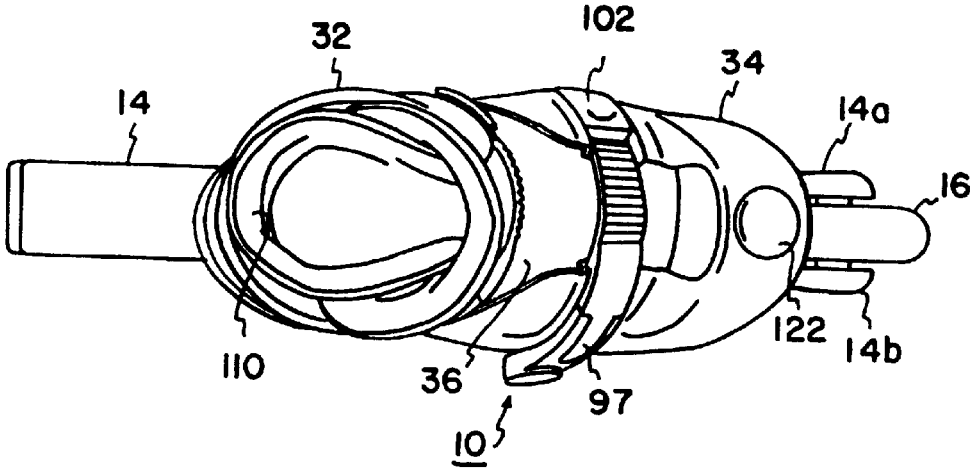
FIG. 7 is a top plan view of the skate of FIG. 1.
Figure 8:
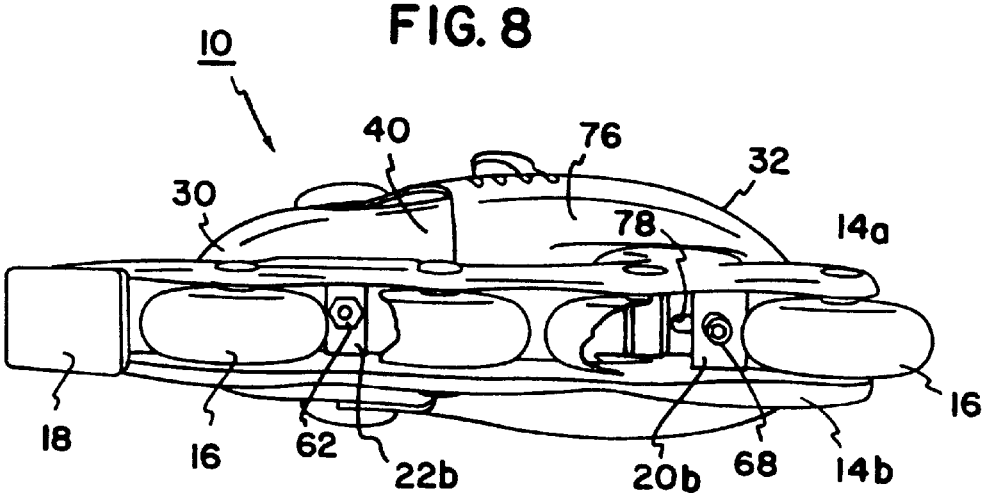
FIG. 8 is a bottom plan view of the skate of FIG. 1.

With reference now to the various drawing figures in which identical elements are numbered identically throughout, a description of the preferred embodiment of the present invention will now be provided.

In the various figures, an in-line skate 10 is illustrated having a skate boot 12 secured to a frame 14 and containing a liner 110. The frame 14 carries a plurality of wheels 16 which, in an in-line skate, are arranged in a line. Also, the frame carries a resilient brake pad 18 as is conventional.

Figure 11:
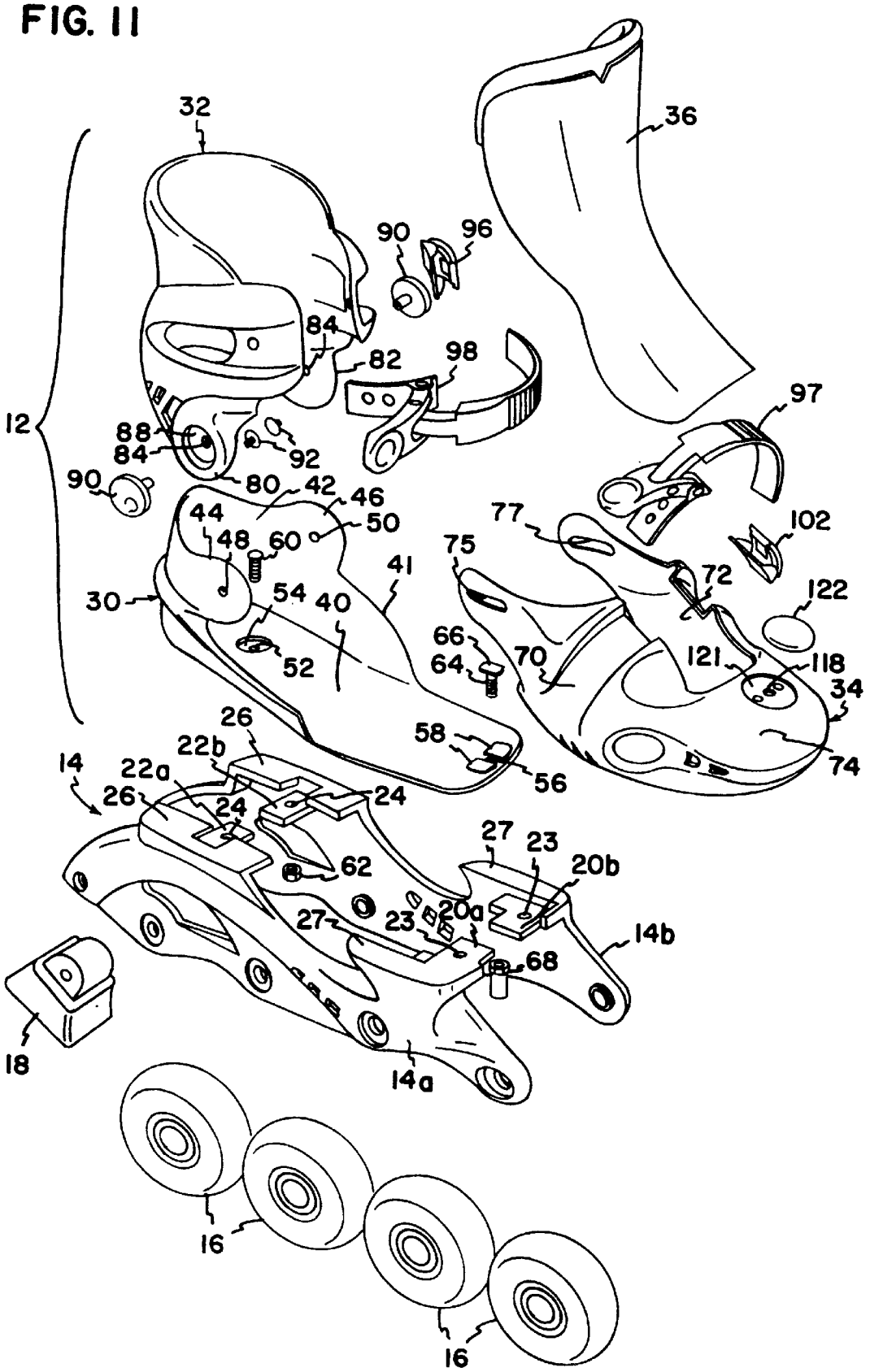
FIG. 11 is an exploded perspective view of the skate of FIG. 1 (without showing a liner)
Figure 12:
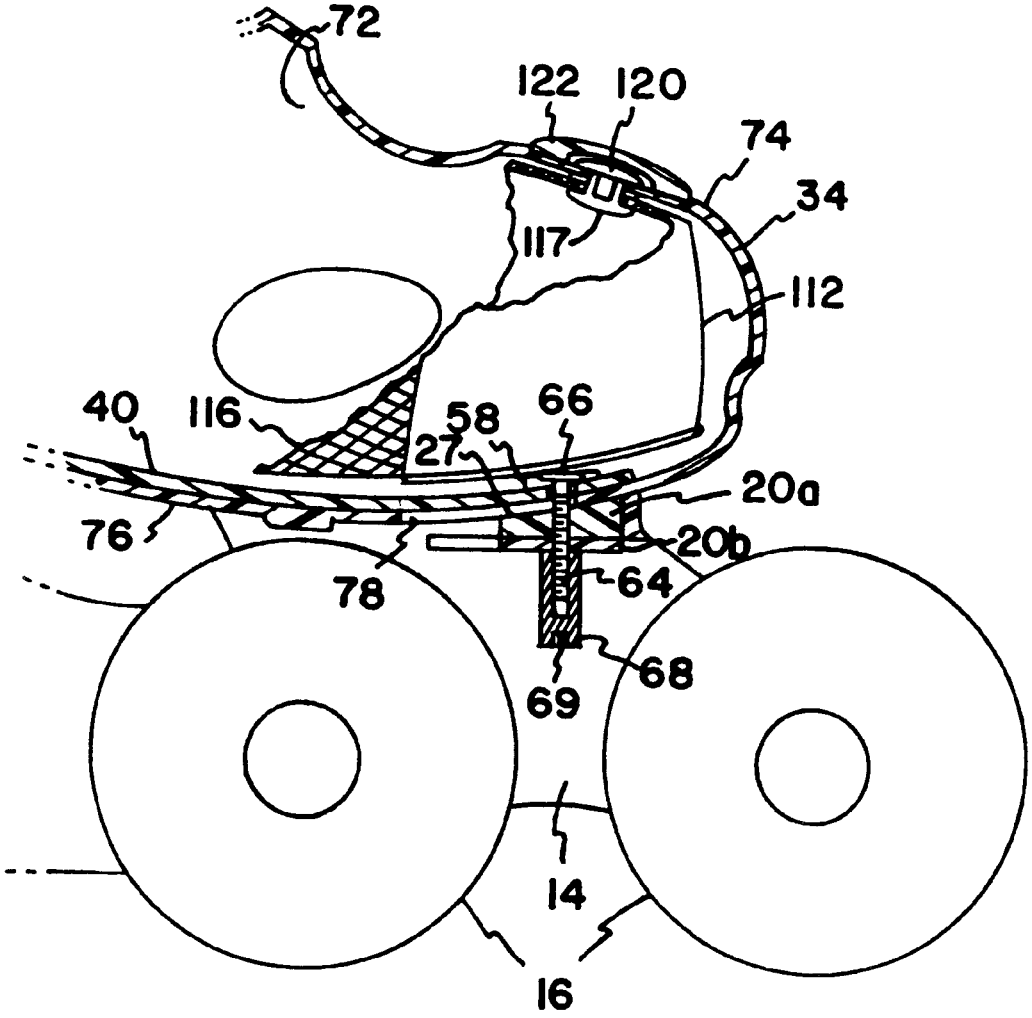
FIG. 12 is a side sectional view of a toe portion of the skate of FIG. 1.

Shown best in FIG. 11, the frame 14 includes two halves 14*a*, 14*b*. The frame halves 14*a*, 14*b* are slidably joined at offset and overlapping front tongues 20*a*, 20*b* (having holes 23) and rear tongues 22*a*, 22*b* (having holes 24). Holes 23 are in alignment when the halves 14*a*, 14*b* are joined. Holes 24 are similarly aligned when the halves 14*a*, 14*b* are joined. When the halves 14*a*, 14*b* are joined together, flat rear upper surfaces 26 of the halves 14*a*, 14*b* are in generally planar alignment to define a rear support platform. Upper surface 27 in the toe area of the frame defines a front support platform when the halves 14*a*, 14*b* are joined. As shown in FIG. 12, surfaces 27 are arcuate to mate with a base 76 to tce portion 34 as will be described.

Referring back to FIG. 11, the boot 12 includes a heel portion 30, cuff 32, toe portion 34 and tongue 36. The heel portion 30 includes a sole 40 and a raised heel wall 42 having sidewalls 44, 46 each with holes 48, 50. The heel wall 42 surrounds the heel and lower ankle of the wearer with wall 46 being raised on the inside of the foot to provide additional support 41 for the arch of the user.

The sole 40 includes a hole 52 formed in a recess 54 at a heel end of sole 40. Similarly, at a toe end of the sole 40, a hole 56 is provided between two ramped surfaces 58. The base or sole 40 is sized to rest on the rear support platform 26 and the front support platform 28 with hole 52 aligned with holes 24 and with hole 56 aligned with holes 23. A bolt 60 is sized to be passed through hole 52 with the head end of the bolt received within the recess 54 and with the bolt 60 further passing through holes 24 and secured by a nut 62. Similarly, a bolt 64 having a head 66 sized to be received between ramped surfaces 58 is provided with the bolt 64 passing through hole 56 and aligned holes 23 and received within an elongated nut 68. As can be seen, since holes 52, 56 are approximately equal to the diameter of bolts 60, 64, once the heel portion 30 is secured to the frame 14, the heel portion 30 is restricted from movement relative to the frame 14.

The toe portion 34 includes a toe box having sidewalls 70, 72 and a top wall 74. Further, as shown in FIG. 12, toe portion 34 has a bottom wall 76. The bottom wall 76 is provided with an elongated slot 78 extending in a longitudinal dimension of the skate to pass the bolt 64. When assembled with the heel portion 30, the toe portion 34 is provided with the base 76 in underlying relation relative to the sole 40 of the heel portion 30. Further, the sidewalls 70, 72 are positioned in overlying relation to the exterior surfaces of the sidewalls 44, 46 of the heel portion 30. The sidewalls 70, 72 are provided with elongated slots 75, 77 aligned with holes 48, 50, respectively. With the construction thus described, upon loosening of elongated nut 68 (by use of an Allen wrench received in hole 69 -- see FIG. 12), the toe portion 34 may move along a line of travel which is generally parallel to the longitudinal dimension of the skate. The slots 75, 77 are aligned such that throughout the path of travel, the slots 75, 77 remain aligned with holes 48, 50.

The cuff 32 is provided to surround an upper ankle area of the wearer and surrounding the heel portion 42 as well as the rearward ends of the sidewall 70, 72. The cuff 32 has at its lower end pivot locations 80, 82 having holes 84, 86 aligned with holes 48, 50. A recessed area 88 surrounds hole 84. Although not shown, an identical recessed area surrounds hole 86.

Figure 13:
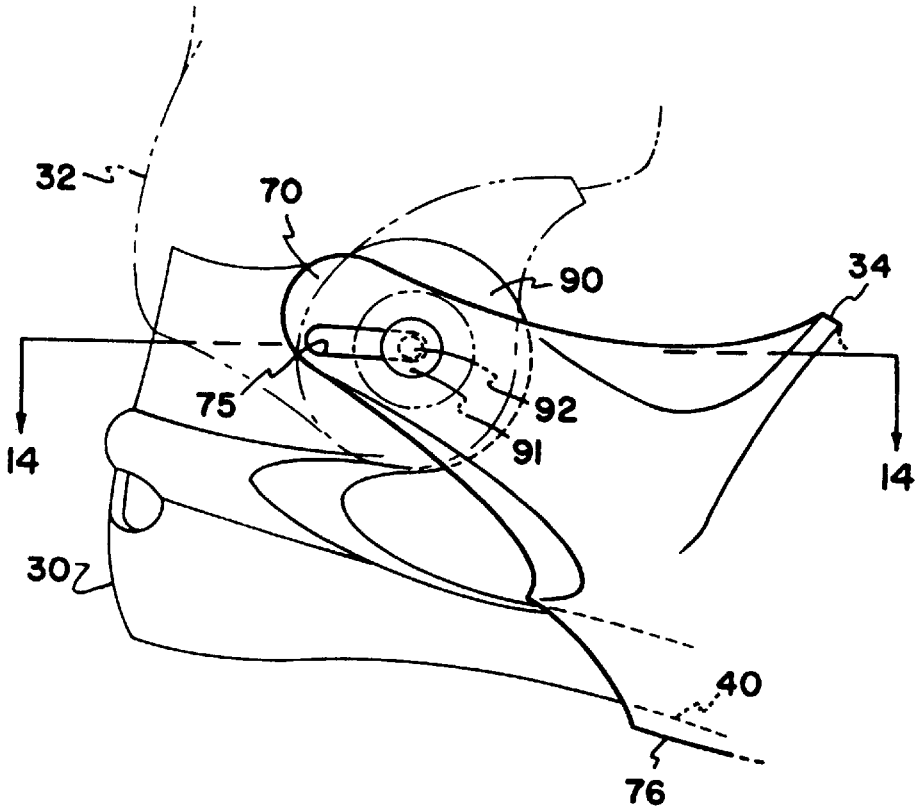
FIG. 13 is an enlarged view of a heel portion of the skate of FIG. 1 (with a cuff shown in phantom and without showing a frame)
Figure 14:
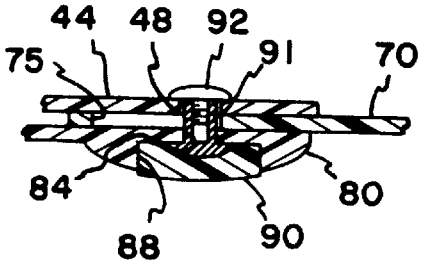
FIG. 14 is a view taken along line 14—14 of FIG. 13.

The attachment of the ends 80, 82 at holes 48, 50 is identical for both sides of the skate and a description with respect to end 80 will suffice as a description of end 82. The attachment is best shown in FIGS. 13 and 14 where a plug 90 (shown partially in phantom) is provided sized to be received within the recess 88 and with a sleeve 91 having an internal thread passed through hole 84, slot 76 and hole 48. A threaded bolt 92 is threaded into the interior of the sleeve 91. This method of attachment permits pivoting movement of the cuff 32 relative to the heel 30 and toe 34. Further, the connection permits relative sliding movement of the toe 34 relative to the heel portion 30 upon the loosening of nut 68.

A conventional buckle arrangement having a release fastener 96 secured to one side of cuff 32 and a tensioning buckle and strap 98 secured to the opposite side of cuff 32 is provided to permit the cuff 32 to be securely fastened to the leg of a wearer. Similarly, a like buckle arrangement having a tension strap and buckle 97 and a release fastener 102 are provided on opposite sides 70, 72 of the toe portion 34 to securely fasten the instep of the wearer's foot to the boot 12. Finally, a tongue 36 is provided as is conventional.

Figure 9:
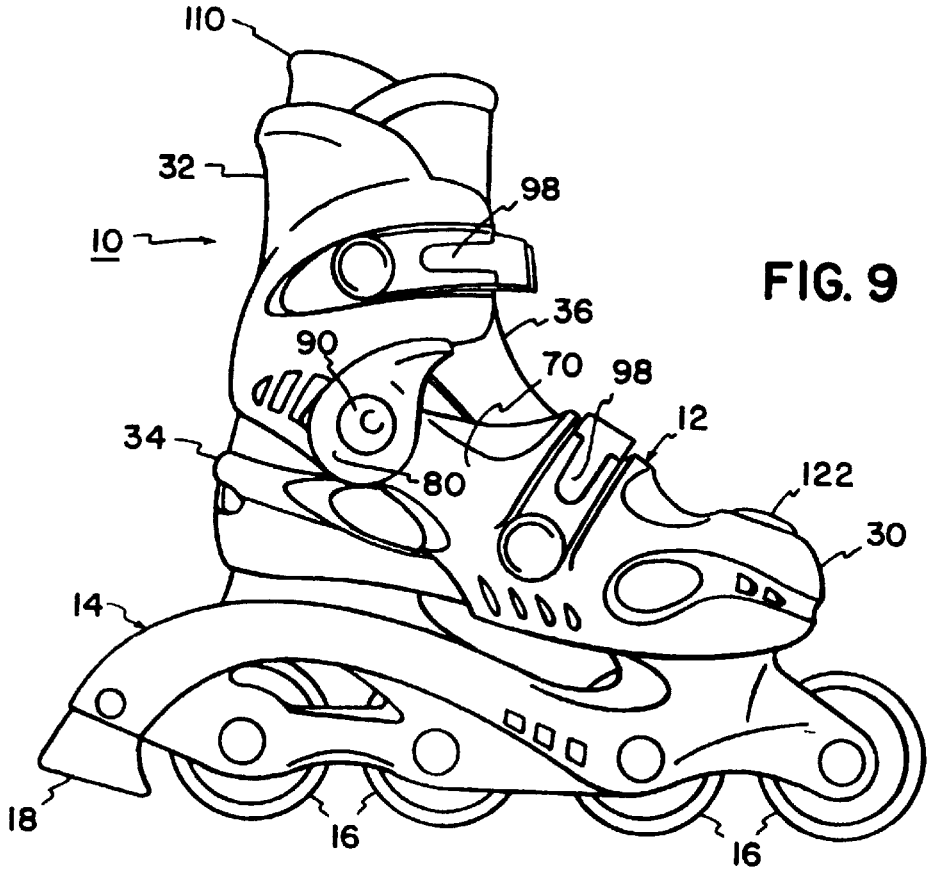
FIG. 9 is the view of FIG. 3 separately shown to compare with FIG. 10.
Figure 10:
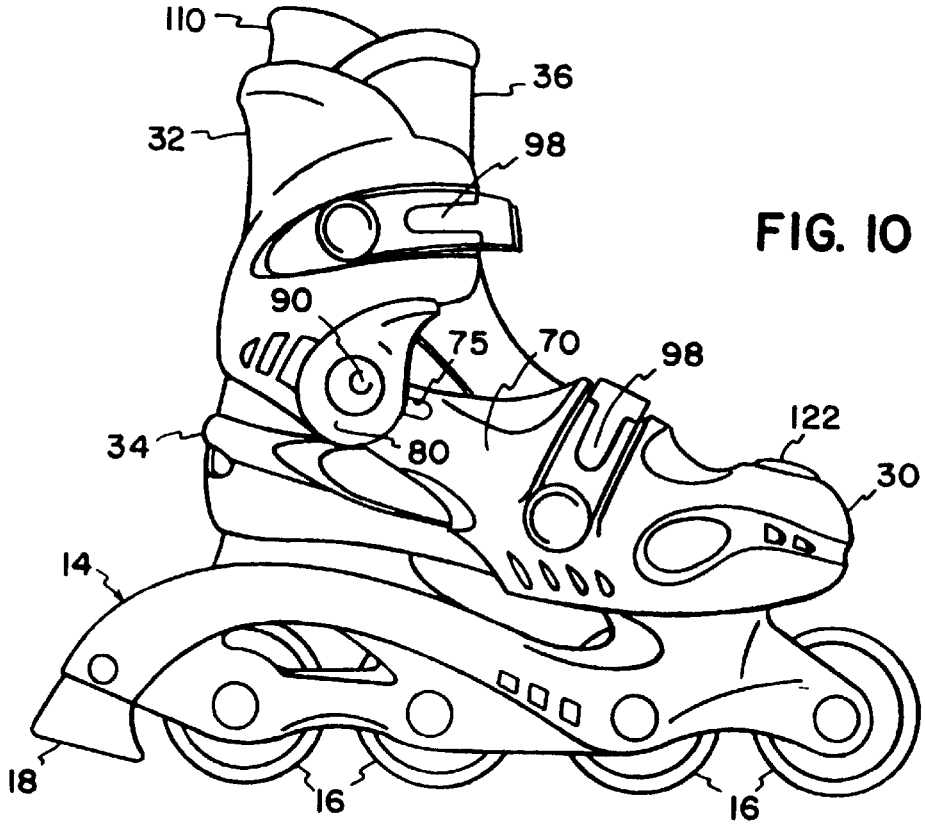
FIG. 10 is the view of FIG. 9 with the skate adjusted to a maximum foot size adjustment.

With the construction thus described, a wide variety of foot sizes can be accommodated by simply loosening nut 68 such that the toe portion 34 is moved relative to the heel portion 30. About four different foot sizes can be achieved by permitting a stroke of movement equal to about one inch. Accordingly, the slots 76, 78 will have a length of about one inch. Since a sliding adjustment is provided, unique adjustment is possible to accommodate unique foot sizes within a range between a minimum foot size (FIG. 9) and a maximum foot size (FIG. 10). Further, the foregoing design permits the use of a pivoting cuff 32 which has numerous advantages in the performance of in-line skating. Also, throughout the adjustment of the length, the positioning of the user's heel relative to the frame 14 and wheels 16 remains unchanged which presents a significant advantage in the performance of in-line skating since heel positioning is important to the performance of the skate.

The present invention also utilizes a novel construction of a liner 110 (FIG. 2) to accommodate increases in shoe size. The use of resilient liners in inline skates is well known. The present liner 110 includes a toe portion 112 joined to the main body portion 114 by an expandable resilient section 116 positioned surrounding the instep area of the foot. Accordingly, the toe portion 112 may move relative to the main body portion 114. A lug 117 is provided on the toe portion 112. The lug 117 is secured to the upper wall 74 of the boot toe 34 by passing the lug 117 through a hole 118 formed in the upper surface 74 and securing the lug 117 in said position by a bolt or screw 120 (FIG. 12). The area surrounding the hole 118 is provided with a recess 121 to receive a decorative cap 122. Accordingly, as a user adjusts the size of the boot by expanding the toe portion 34 of the boot, the toe 112 of the skate liner 110 follows the toe 34 of the boot 12.

From the foregoing detailed description of the present invention, it has been shown how the objects of the invention have been attained in the preferred manner. However, modifications and equivalents of the disclosed concepts such as those which readily occur to one skilled in the art are intended to be included within the scope of the claims which are appended hereto.

What is claimed is:

1. An adjustable fit in-line skate comprising:

a rigid frame having a plurality of in-line skate wheels secured thereto;

a boot including a toe portion and a heel portion;

said heel portion having a sole and upwardly extending sidewalls with outer surfaces, said heel portion including a first fastener securing said heel portion to said frame;

said toe portion having a base in sliding relation to said sole, said toe portion including a second fastener securing said toe portion to said heel portion, said base being releasably secured to at least a portion of said frame by said second fastener with said toe portion slidable relative to said heel portion along a line of travel generally parallel to a longitudinal dimension of said skate;

a cuff portion with sidewalls extending upwardly from said sidewalls of said heel portion; and said toe portion including sidewalls adjustably secured to said sidewalls of said heel portion by a fastening system with at least a portion of said sidewalls of said toe portion adjacent to said outer surfaces of at least a portion of said sidewalls of said heel portion.

2. The adjustable fit in-line skate according to claim 1 wherein said third fastener connects said sidewalls of said cuff portion to said sidewalls of said toe portion and said sidewalls of said heel portion.

3. The adjustable fit in-line skate according to claim 2 wherein at least a portion of said sidewalls of said toe portion are juxtaposed between at least a portion of said sidewalls of said heel portion and at least a portion of said sidewalls of said cuff portion.

4. The adjustable fit in-line skate according to claim 1 wherein said frame includes a front platform and a rear platform; wherein said sole of said heel is secured to said rear platform; and wherein each of said base and said sole are secured to said front platform.

5. The skate according to claim 1 wherein said second fastener is operable by a user to adjust said second fastener between a fastened position and an unfastened position, said sidewalls of said toe portion fixed from movement relative to said third fastener when said second fastener is in said fastened position and said sidewalls of said toe portion free to move along said line of travel relative to said third fastener when said second fastener is in said unfastened position.

6. An adjustable fit in-line skate comprising:

a rigid frame having a plurality of in-line skate wheels secured thereto;

a boot including a toe portion and a heel portion;

said heel portion having a sole and upwardly extending sidewalls, said heel portion including a first fastener fixedly securing said heel portion to said frame;

said toe portion having a base in sliding relation to said sole, said toe portion including a second fastener securing said toe portion to said heel portion, said base being releasably secured to at least a portion of said frame by said second fastener with said toe portion slidable relative to said heel portion along a line of travel generally parallel to a longitudinal dimension of said skate and with said heel portion fixed from movement relative to said toe portion along said line of travel;

a cuff portion with sidewalls extending upwardly from said sidewalls of said heel portion; and said toe portion including sidewalls slidably fastened to said sidewalls of said heel portion by a fastening system.

7. The adjustable fit in-line skate according to claim 6 wherein said third fastener connects said sidewalls of said cuff portion to said sidewalls of said toe portion and said sidewalls of said heel portion.

8. The adjustable fit in-line skate according to claim 7 wherein at least a portion of said sidewalls of said toe portion are juxtaposed between at least a portion of said sidewalls of said heel portion and at least a portion of said sidewalls of said cuff portion.

9. The adjustable fit in-line skate according to claim 7 wherein said third fastener pivotally connects said cuff portion to said heel portion.

10. The adjustable fit in-line skate according to claim 6 wherein said frame includes a front platform and a rear platform; wherein said sole of said heel is secured to said rear platform; and wherein each of said base and said sole are secured to said front platform.

11. The adjustable fit in-line skate according to claim 6 wherein said second fastener passes through each of said sole and said base, said second fastener being operable by a user to adjust said second fastener between a fastened position and an unfastened position, said sole and base fixed from movement relative to said second fastener in said fastened position and said base free to move along said line of travel relative to said second fastener in said unfastened position.

12. An adjustable fit in-line skate comprising:

a frame having substantially parallel rails;

a plurality of in-line skate wheels mounted between the rails, the in-line skate wheels including a front wheel, a front intermediate wheel trailing the front wheel, a rear intermediate wheel trailing the front intermediate wheel and a rear wheel trailing the rear intermediate wheel;

a boot including a heel portion and a toe portion, the heel portion including a sole, and the toe portion including a base, a top wall and side walls extending between the base and the top wall;

the toe portion being slidable relative to the heel portion along a line of travel generally parallel to a longitudinal axis of the skate;

the heel portion being generally fixed longitudinally relative to the frame;

a fastening arrangement for releasably securing the toe portion in a desired longitudinal position relative to the heel portion, the fastening arrangement including a single fastening member, the single fastening member extending vertically between the rails of the frame, the single fastening member being aligned generally along a longitudinal centerline of the skate, and the single fastening member being aligned generally between the front wheel and the front intermediate wheel; and the base of the toe portion being oriented in an underlying relation relative to the sole of the heel portion, wherein the base of the toe portion slides between the frame and the sole of the heel portion when the toe portion is moved along the line of travel.

13. The adjustable fit in-line skate of claim 12, wherein the heel portion includes side walls having exterior surfaces, and the side walls of the toe portion are positioned in overlying relation relative to the exterior surfaces of the side walls of the heel portion.

14. The adjustable fit in-line skate of claim 12, wherein the fastening member comprises a bolt.

15. The adjustable fit in-line skate of claim 12, wherein fastening member extends through a frame opening defined by the frame at a location between the rails of the frame.

16. An adjustable fit in-line skate comprising:

a frame having two spaced-apart, substantially parallel rails;

a plurality of in-line skate wheels secured between the rails of the frame, the in-line skate wheels including a front wheel, a front intermediate wheel trailing the front wheel, a rear intermediate wheel trailing the front intermediate wheel and a rear wheel trailing the rear intermediate wheel;

a boot including a heel portion and a toe portion;

the toe portion being slidable relative to the heel portion along a line of travel generally parallel to a longitudinal axis of the skate;

the heel portion being generally fixed longitudinally relative to the frame; and a fastening arrangement for releasably securing the toe portion in a desired longitudinal position relative to the heel portion, the fastening arrangement including a singe fastening member, the single fastening member being positioned between the rails of the frame and being aligned generally alone a longitudinal centerline of the skate, the single fastening member also being aligned generally between the front wheel and the front intermediate wheel.

17. The adjustable fit in-line skate of claim 16, wherein fastening member extends through a frame opening defined by the frame at a location between the rails of the frame.

18. The adjustable fit in-line skate of claim 17, wherein the fastening member extends through an elongated opening defined by a base of the toe portion, the elongated opening being elongated in a direction generally parallel to the longitudinal axis of the skate.

19.The adjustable fit in-line skate of claim 16, wherein the fastening member includes a nut and a bolt.

20. The adjustable fit in-line skate of claim 16, wherein the boot further includes a cuff portion pivotally connected to the heel portion.

21. The adjustable fit in-line skate of claim 16, wherein the heel portion includes a sole and side walls that are integrally connected as a single seamless piece.

* * * * *

UNITED STATES PATENT AND TRADEMARK OFFICE

CERTIFICATE OF CORRECTION

PATENT NO. : 5,913,526

DATED : JUNE 22, 1999

INVENTOR(S) : OLSON ET AL.

It is certified that error appears in the above-identified patent and that said Letters Patent is hereby corrected as shown below:

Col. 3, line 61: "inline" should read —in–line—

Col. 6, line 42, claim 16: "singe" should read —single—

Col. 6, line 44, claim 16: "alone" should read —along—

Signed and Sealed this

Fifth Day of December, 2000

*Attest:*

*Attesting Officer*

Q. TODD DICKINSON

*Director of Patents and Trademarks*